United States Patent [19]

Pedersen

[11] Patent Number: 4,779,401

[45] Date of Patent: Oct. 25, 1988

[54] ARRANGEMENT FOR MANUFACTURING AND PACKAGING CARDS, ESPECIALLY PLAYING CARDS

[76] Inventor: Thomas Pedersen, Manosquer Strasse 6, 7022 Leinfelden 1, Fed. Rep. of Germany

[21] Appl. No.: 53,958

[22] Filed: May 22, 1987

[30] Foreign Application Priority Data

May 31, 1986 [DE] Fed. Rep. of Germany ..... 3618384

[51] Int. Cl.[4] ..... B65B 63/00; B65B 35/50

[52] U.S. Cl. ..... 53/520; 53/540; 83/86; 493/959

[58] Field of Search ..... 53/513, 520, 540; 493/959; 83/78, 86; 198/575, 576

[56] References Cited

U.S. PATENT DOCUMENTS

| | | | |
|---|---|---|---|
| 2,193,638 | 3/1940 | Morton | 493/959 X |
| 2,360,973 | 10/1944 | Pedersen | 493/959 X |
| 3,939,621 | 2/1976 | Giori | 53/520 X |
| 3,955,337 | 5/1976 | Bleich | 53/520 |
| 4,203,334 | 5/1980 | Zettler | 83/86 X |
| 4,283,902 | 8/1981 | Giori | 53/520 X |
| 4,558,557 | 12/1985 | Kuehfuss | 53/520 X |

*Primary Examiner*—Horace M. Culver
*Attorney, Agent, or Firm*—Erwin S. Teltscher

[57] ABSTRACT

A manufacturing and packaging arrangement for cards, especially playing cards, includes a sheet cutting and card stacking station, two corner punching stations, and a packaging stations which are connected with one another by a conveyor arrangement that is driven by a motor. In the cutting and stacking station, printed sheets are cut up into individual cards and those cards which belong to respective sets are assembled into respective card stacks which are then discharged from the cutting and stacking station by a discharge arrangement and transferred by a transfer conveyor to an intermittently driven main conveyor. At the main conveyor, the individual card stacks are engaged by entraining fingers which extend into a transporting channel, and are intermittently transported longitudinally of the channel to the corner punching stations. A translationally displaceable supply and return conveyor moves and card stacks transversely to the main conveyor into and out of the respective corner punching station during the time periods of standstill of the main conveyor, for the arcuate punching of two corners of the card stack in each instance. At the downtream end of the main conveyor, the card stacks are transferred by an additional transfer conveyor to the packaging station. The various stations and conveyors are jointly driven by a single motor and synchronizing transmissions.

19 Claims, 5 Drawing Sheets

ARRANGEMENT FOR MANUFACTURING AND PACKAGING CARDS, ESPECIALLY PLAYING CARDS

BACKGROUND OF THE INVENTION

The present invention relates to card manufacture in general, and more particularly to an arrangement for manufacturing and packaging cards, especially playing cards.

There are already known various constructions of arrangements for manufacturing and packaging playing cards, among them such which include a card cutting and stacking station in which printed sheets provided with images on both of their major surfaces are subdivided into individual cards of identical size and the cards belonging to respective sets are assembled into respective card stacks which are then intermittently transported by a chain conveyor to respective corner punching stations at each of which two of their corners are rounded off by punching, after which the card stacks are conveyed to a packaging station at which they are wrapped or otherwise packaged. In one known card manufacturing and packaging arrangement of this type, the card stacks are removed from the chain conveyor at the respective corner punching stations transversely with respect to the chain conveyor, and are temporarily held stationary in the corner cutting station underneath two corner punching blades by clamping jaws. The corner punching blades are mounted on a punching beam which is constructed as a metallic transverse beam. The punching beam can be moved by means of a separately driven crank drive from an upper rest position into a punching position and back again. In this construction, the weight of the punching beam has primarily the purpose of overcoming during the punching operation the friction resistance occurring in the transmission, at the sliding guides for the punching beam and in the sliding bearings of the crank drive and of the punching shaft. The punching operation proper is performed by utilizing the force of an electric motor, whose rotational movement is stepped down by a worm transmission and transformed by the aforementioned crank drive into an up and down movement of the punching beam. Hence, the drive for the punching beam is independent of the conveying arrangement and it is controlled via a braking coupling by the card stacks which move on the main conveyor by means of a microswitch or a light barrier. As a result of relatively huge masses which are to be moved, of the relatively high friction in the driving system, and the slow operation of the braking couplings, it was possible to achieve only relatively low machine operation frequencies when using this known installation. This is so because each machine cycle includes a braking point at which all of the masses have to be retarded and subsequently accelerated again. The higher is the operating frequency, the higher are the inertial forces which increase with the square of the operating frequency.

SUMMARY OF THE INVENTION

Accordingly, it is a general object of the present invention to avoid the disadvantages of the prior art.

More particularly, it is an object of the present invention to provide a card manufacturing and packaging arrangement which does not possess the drawbacks of the known arrangements of this type.

Still another object of the present invention is to devise an arrangement of the type here under consideration which can be operated at much higher cycling frequencies than heretofore possible.

It is yet another object of the present invention to design the above arrangement in such a manner as to require a much lower amount of power for operation thereof despite the higher-speed operation thereof.

A concomitant object of the present invention is so to construct the arrangement of the above type as to be relatively simple in construction, inexpensive to manufacture, easy to use, and yet reliable in operation.

In keeping with these objects and others which will become apparent hereafter, one feature of the present invention resides in an arrangement for the manufacture and packaging of cards, especially playing cards. According to the invention, this arrangement includes a cutting and stacking station operative for cutting out cards from printed sheets and for assembling pluralities of the cards belonging to respective sets into respective card stacks; two corner punching stations equipped with respective punching blades for the removal of the card corners; a packaging station for the packaging of the card stacks, and means for conveying the card stacks. The conveying means includes an intermittently operated main conveyor, a transfer conveyor connecting the cutting and stacking station with the main conveyor, two supply and return conveyors each of which connects the main conveyor with one of the corner punching stations and is operated during the rest times of the main conveyor, and another transfer conveyor which connects the main conveyor with the packaging station. The arrangement of the present invention further includes means for jointly driving all of the stations and conveyors, including a single motor and synchronizing transmissions.

The present invention is based on the idea that the inertial forces which are to be overcome at a predetermined operating frequency of the machine can be minimized by driving the working stations, such as the cutting and stacking station, corner punching stations and the packaging station, as well as the conveyors which interconnect such stations, jointly by a single motor and synchronizing transmissions In this manner, overdimensioning of the driving means is avoided. Instead of the heretofore customary braking couplings, there can be used stepping transmissions which render possible, when using cam or crank disks, a largely frictionless and low-inertia transformation of the continuous rotation of the motor output shaft into stepping motions. When then additionally the translators and rotary bearings of the corner punching stations are constructed as low-friction ball or roller bearings, then the moving mass of the punching beam can be so dimensioned for the purpose of minimizing the driving power and maximizing the cycling frequency that it exerts, under the influence of the gravitational forces, a force on the cards which equals at least 0.5 times, but preferably between 0.6 and 1 times the punching force which is needed for the punching through the cards. In this case, only the force which is still missing for the accomplishment of the punching-through operation need be additionally supplied by the joint driving mechanism. This additional force is just sufficient during the return movement of the punching beam with the punching blades for lifting the punching beam and the punching blades by means of a cam or crank transmission into their rest position, so that there is assured an optimum utilization of the output power of the motor over the entire operating cycle and an unnecessary over-dimensioning is avoided.

According to a further advantageous aspect of the present invention, the main conveyor is oriented horizontally and includes two conveyor chains that are arranged at a transverse distance from one another and are simultaneously driven from an intermittently turning shaft of the driving means. A plurality of entraining members is arranged in the region between the conveyor chains one after the other as considered in the longitudinal direction of the main conveyor. The entraining members are connected to the conveyor chains by means of two pluralities of insertion shafts arranged on opposite sides of the entraining members and each connecting the connecting members to one of the conveyor chains. The insertion shafts of one of the pluralities are offset by a predetermined distance in the longitudinal direction from the insertion shafts of the other of the pluralities. The conveyor chains are trained about respective reversing chain sprockets arranged at respective longitudinal ends of the main conveyor. The reversing chain sprockets are mounted for rotation about axes which are offset from one another in the longitudinal direction by the predetermined distance. There is further provided a plurality of entraining fingers each of which upwardly projects from one of the entraining members. By resorting to this particular construction, it is achieved that the entraining fingers always extend upwardly from the entraining members in any position of such entraining members. Advantageously, there is further provided a multitude of rollers each of which is mounted on one of the entraining shafts, and a rolling track which is contacted by the rollers at least at the region of the upper run of the main conveyor. In this connection, it is particularly advantageous when the main conveyor further includes at the region of the upper run thereof and at an upward distance from the running track a transporting trough including a bottom wall having a slot-shaped opening for the passage of the entraining fingers therethrough and two lateral walls, the walls delimiting an upwardly open transportation channel for the card stacks.

According to another facet of the present invention, the driving means includes a stepping transmission connected with the motor and operative for intermittently driving the conveyor chains of the main conveyor. This stepping transmission advantageously includes a driving cam wheel mounted on a continuously rotating shaft and provided with entraining cams, and a driven wheel, such as a toothed wheel or a roller wheel, which is intermittently turnable by the cams of the driving cam wheel and is coupled with a transmission chain for the main conveyor. It is also advantageous when the transfer conveyor which extends from the cutting and stacking station to the main conveyor includes a conveyor chain which is intermittently driven by the driving cam wheel and another driven wheel and which includes additional entraining fingers which penetrate into the discharge of the cutting and stacking station, and into the end of which that is remote from the cutting and stacking station there extend the entraining fingers of the main conveyor. The transfer conveyor may include a pendulum transmission which is driven by a cam wheel mounted on a main shaft and has a free end, and a shifting element for the card stacks mounted on the free end of the pendulum, movable transversely of the main conveyor, and extending into the path of the main conveyor. However, it is especially advantageous when each of the supply and return conveyors includes a pendulum transmission which is driven by a cam wheel mounted on a main shaft and has a free end, and a shifting element for the card stacks mounted on the free end of the pendulum, movable transversely of the main conveyor into and out of the respective corner punching station, and extending into the path of the main conveyor. Last but not least, it is advantageous when the additional transfer conveyor which leads to the packaging station includes a conveyor chain which is driven either continuously or intermittently by the motor and includes entraining fingers for the card stacks present at the downstream end of the main conveyor.

BRIEF DESCRIPTION OF THE DRAWING

The present invention will be described below in more detail with reference to the accompanying drawing in which.

DETAILED DESCRIPTION OF THE PREFERRED EMBODIMENT

Figure 1:
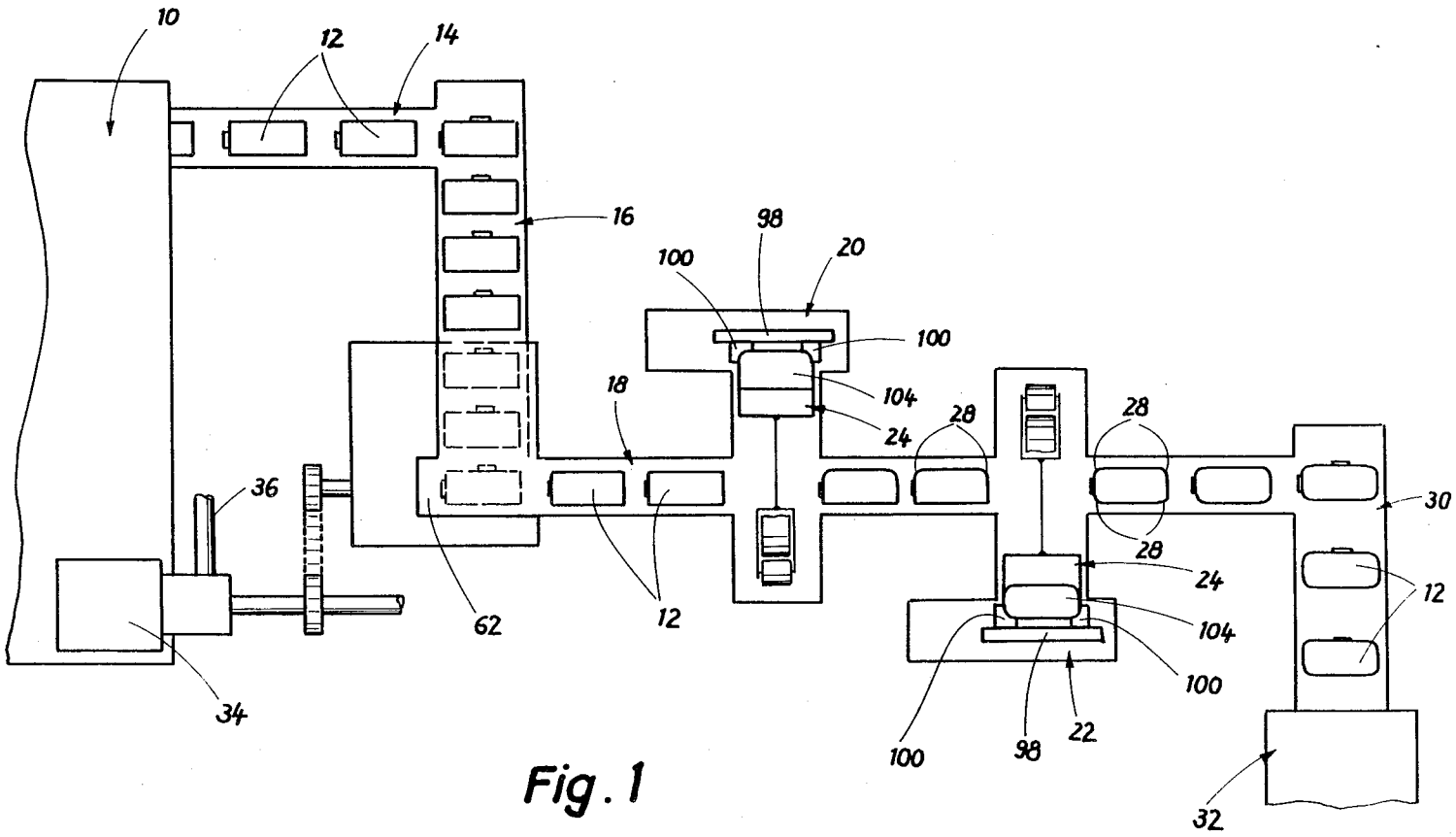
FIG. 1 is a diagrammatic top plan view of a manufacturing and packaging arrangement embodying the present invention.

Referring now to the drawing in detail, and first to FIG. 1 thereof, it may be seen that the reference numeral 10 has been used therein to identify a cutting and stacking station of an assembly line for stacks of cards or similar sheet-shaped objects, especially playing cards, in which printed sheets that are provided with printed matter both on their front and at their rear major surfaces are being withdrawn from a supply stack of such sheets, cut up into rectangular cards of identical sizes and then assembled in respective sets into respective card stacks 12. The card stacks 12 are then being delivered from the cutting and stacking station 10 via a card stack discharge arrangement 14 and a transfer conveyor arrangement 16 to an intermittently driven main conveyor arrangement 18. Along the main conveyor arrangement 18, there are arranged at a distance from one another two corner punching stations 20 and 22 which can be supplied during the stoppage periods of the main conveyor arrangement 18, by means of a supply and discharge conveyor arrangement 24 that is displaceable transversely with respect to the main conveyor arrangement 18, with the respective card stack 12 which is then situated at the respective associated location of the main conveyor arrangement 18, for the purpose of arcuate punching of a different card stack corner pair 28 in each instance. At the downstream end of the path of the main conveyor arrangement 18, the card stacks 12 are supplied via a further transfer conveyor arrangement 30 to a packaging station 32 in which the respective card stacks 12 are provided, for instance, with cellophane sleeves.

Figure 2:
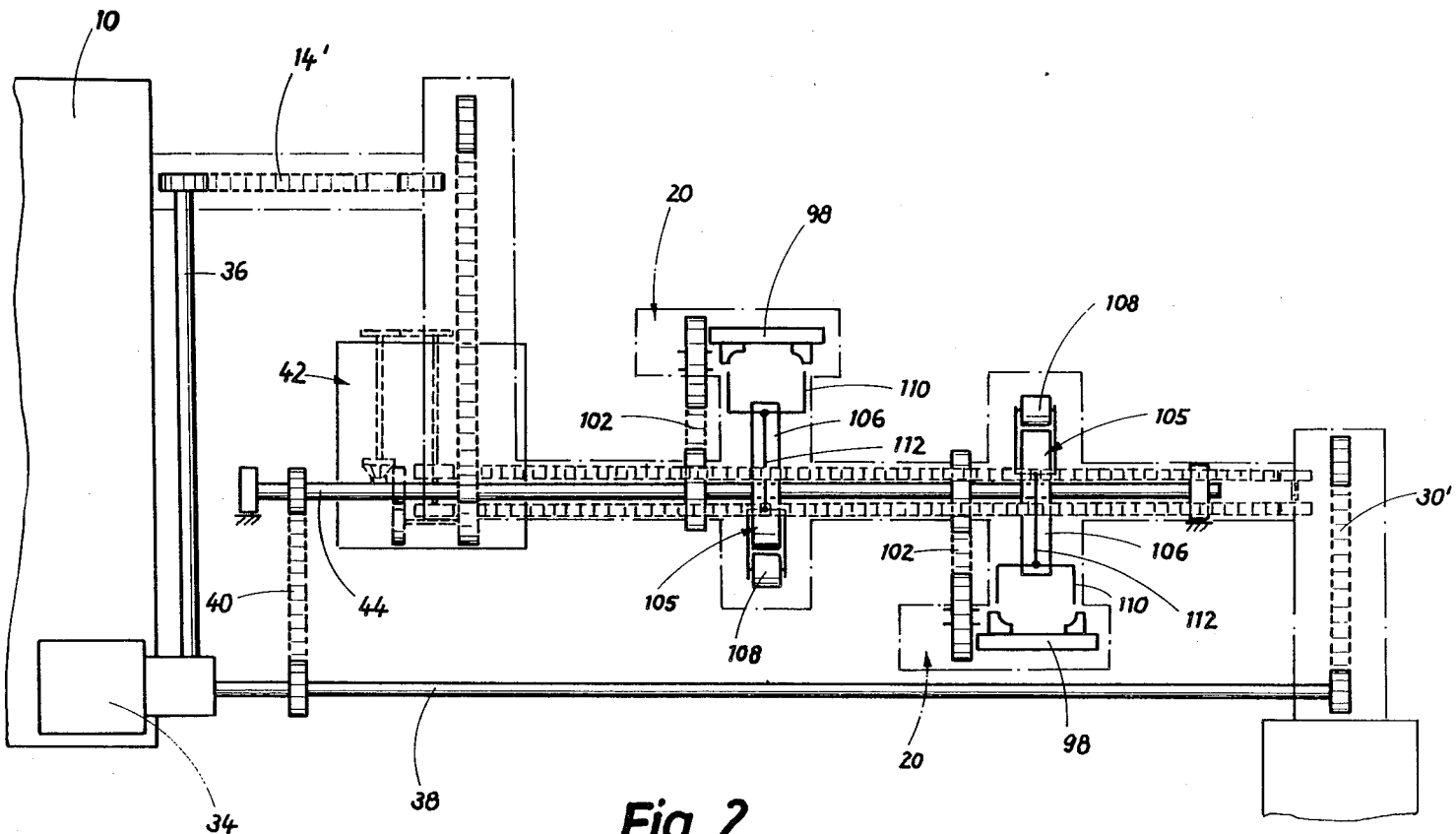
FIG. 2 is a diagrammatic view of a driving arrangement for the manufacturing and packaging arrangement of FIG. 1.

As can be seen especially in FIG. 2 of the drawing, all of the operating stations and conveyor arrangements are being commonly driven in synchronism with one another by an electric motor 34, as well as by suitable transmission devices. The transmission devices that are shown in the drawings diagrammatically indicate respective couplings which are provided thereat. These couplings can be technically realized in various ways.

Figure 3:
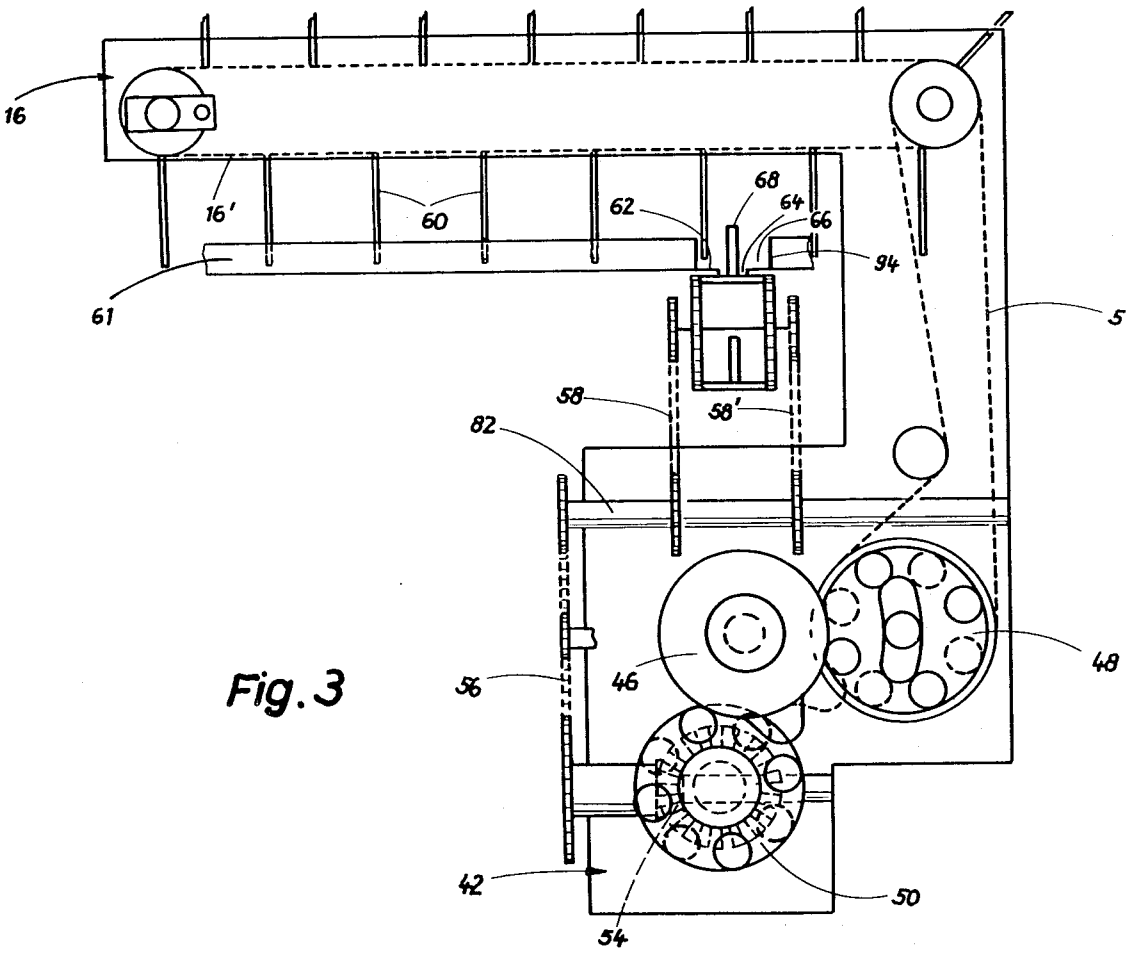
FIG. 3 is an end elevational view of a stepping transmission for the transfer conveyor and the main conveyor of the manufacturing and packaging arrangement of FIG. 1.
Figure 4:
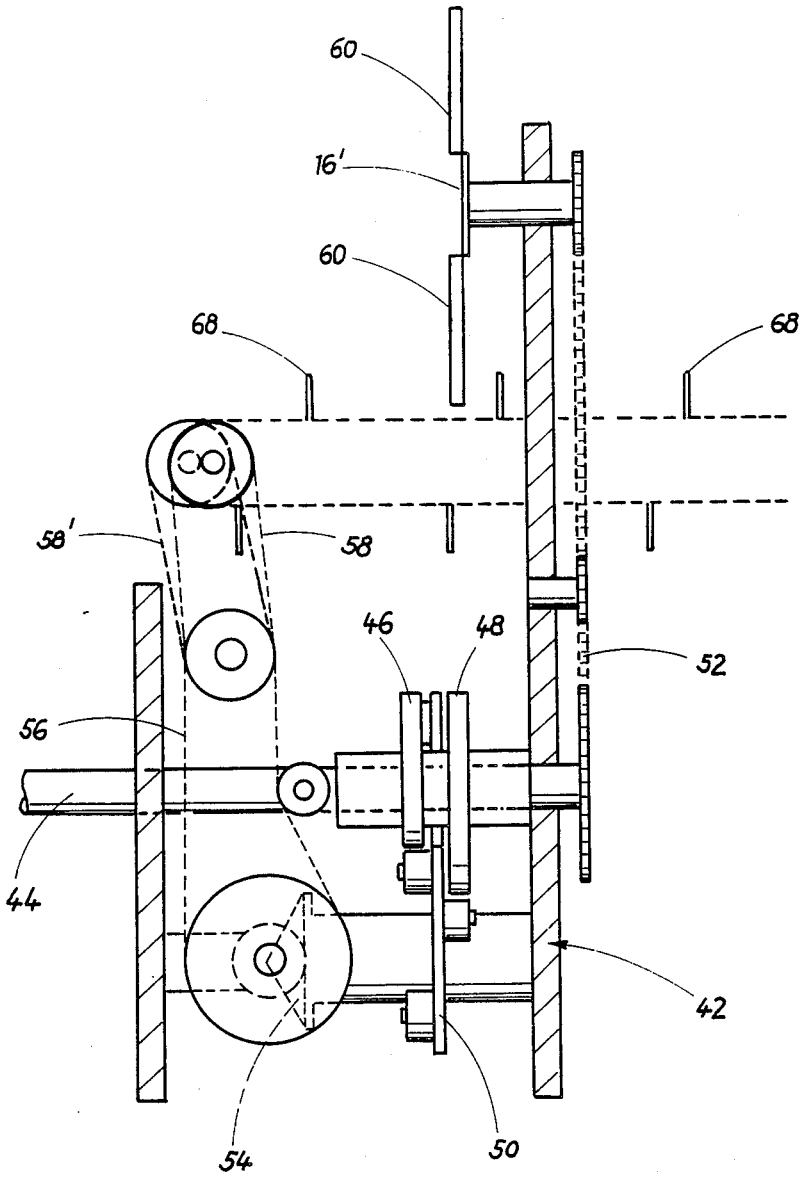
FIG. 4. is a side elevational view of the stepping transmission of FIG. 3.

The electric motor 34 which is constructed as a geared motor, drives, on the one hand, via a shaft 36, a conveyor chain 14' of the card stack discharging arrangement 14 of the cutting and stacking station 10. On the other hand, a further driving shaft 38 of the geared motor 34 drives, via a transmission chain 40, a main shaft 44 of the conveying arrangement, as well as a transfer conveyor 30' of the transfer conveyor 30, which leads to the packaging station 32. The main shaft 44 extends into a housing of a stepping transmission 42 where it carries, as shown particularly in FIG. 3 of the drawing, a cam wheel 46 which acts during each revolution of the main shaft 44 at spaced time intervals on each of two roller wheels 48 and 50 to turn the same through 90° in each instance. The first roller wheel 48 acts on a transmission chain 52 which leads to a transfer conveyor 16' of the transfer conveyor arrangement 16, while the second roller wheel 50 drives, via an angular transmission 54 as well as via a second chain transmission 56 and a third chain transmission 58 and 58', a main conveyor 18' of the main conveyor arrangement 18. The transfer conveyor 16' is constructed as a chain conveyor having perpendicularly projecting entraining fingers 60 which engage the respective card stack 12 that is being transferred at the downstream end of the card stack discharging arrangement 14 and transport it in an upwardly open transportation channel 61 of the transfer conveyor arrangement 16 to an input location 62 of the main conveyor arrangement 18. At this input location, the card stacks 12 are engaged by fingers 68 of the main conveyor 18' which extend from below to above through a slot-shaped opening 64 provided in the bottom wall of a transporting channel 66 of the main conveyor arrangement 18 and are then transported by these fingers 68 in the longitudinal direction of the transporting channel 66 of the main conveyor arrangement 18. As may be ascertained from FIG. 3 of the drawing, the transfer conveyor 16' and the main conveyor 18' are so driven in a stepped manner with a predetermined phase shift that initially a card stack 12 is transported into the input location 62 of the main conveyor arrangement 18 and is stopped thereat. Only thereafter is the main conveyor 18' set in motion via the roller wheel 50, so that it performs an advancement step corresponding to the distance between two of the entraining fingers 68.

Figure 5:
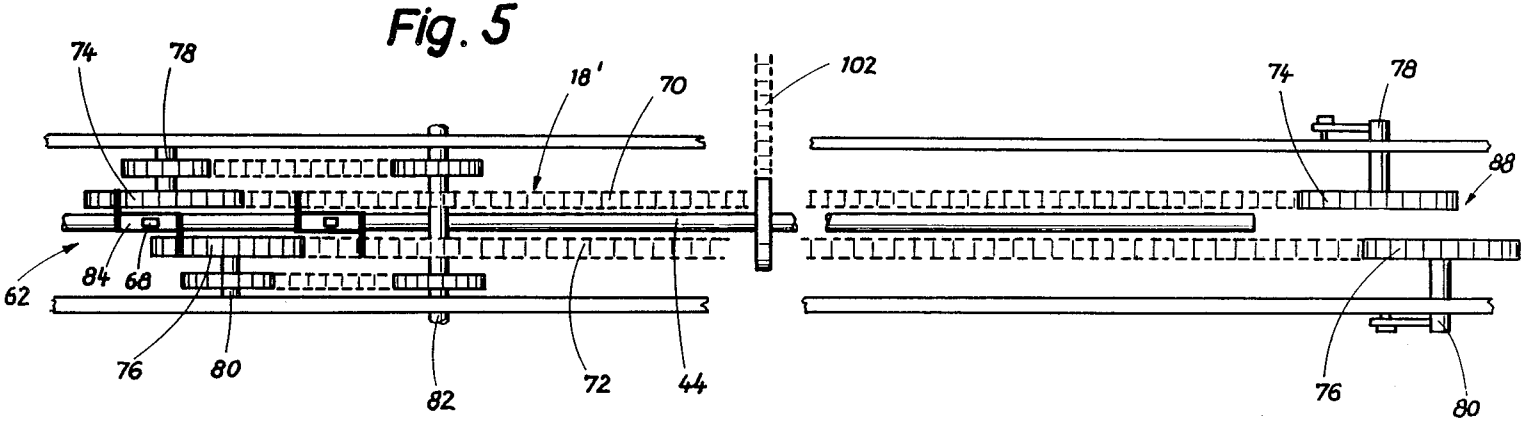
FIG. 5 is a top plan view of a driving mechanism of the main conveyor of the manufacturing and packaging arrangement of FIG. 1.
Figure 6:
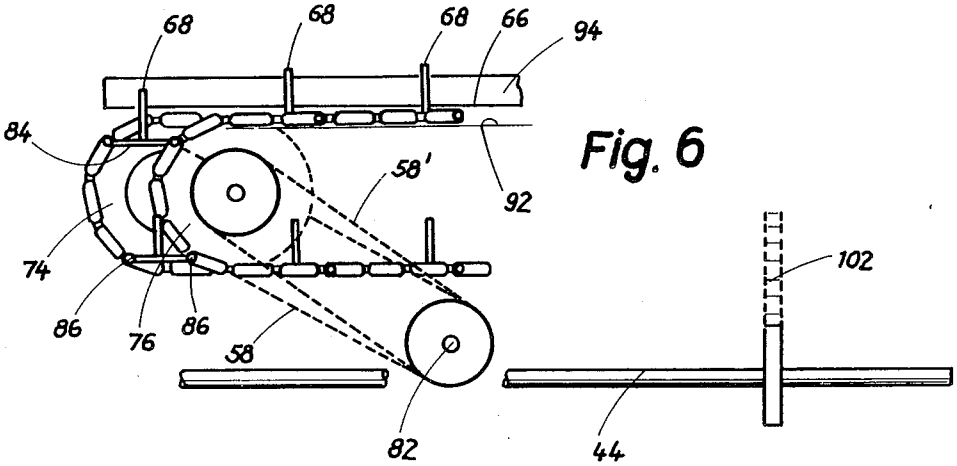
FIG. 6 is a side elevational view of the driving mechanism of FIG. 5.
Figure 7:
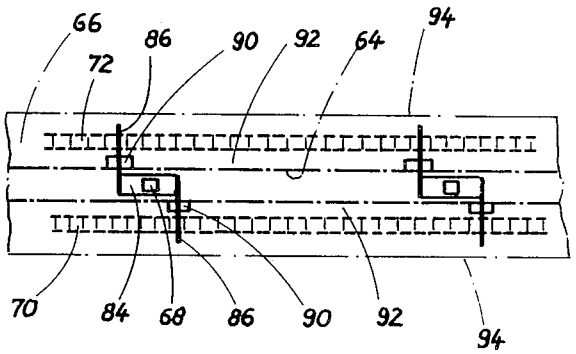
FIG. 7 is a top plan view of a fragmentary detail of the main conveyor of the manufacturing and packaging arrangement of FIG. 1.

As may be seen particularly in FIGS. 5, 6 and 7 of the drawing, the main conveyor 18' consists of two chains 70 and 72 which are arranged at a distance from one another and which are trained about reversing sprockets 74 and 76 that are mounted for rotation on shafts 78 and 80 which are offset from one another in the longitudinal direction of the main conveyor 18'. The driving of the two chains 70 and 72 is accomplished by means of identical chain transmissions 58 and 58' from a common driving shaft 82. On each of the two chains 70 and 72, there is articulately mounted at a distance from one another a plurality of plates 84 each of which carries one of the entraining fingers 68, by means of respective insertable axles 86 each two of which extend to mutually opposite sides of the associated plate 84. The insertable axles 86 have a distance from one another which corresponds to the axial distance between the chain sprockets 74 and 76. In this manner, it is achieved that the entraining fingers 68 extend perpendicularly upwardly over the entire chain path. This is also true with respect to the reversing locations at which the respective entraining finger 68 is introduced into the transporting path 66 at the input location 62 perpendicularly from below, and is withdrawn from the transporting path 66 perpendicularly downwardly at a discharge location 88. Each of the insertable shafts 86 additionally carries a caster 90 which is in contact with a rolling track 92 at least at the region of the upper run of the chain conveyor 18'. At a spacing above the rolling track 92, there is arranged the transporting channel 66 for the card stacks 12, which has the aforementioned, centrally located slot-shaped opening 64 for the passage of the entraining fingers 68 therethrough and which is delimited at its lateral edges by vertically extending lateral walls 94.

Each of the two corner punching stations 20 and 22 which are arranged along the main conveyor arrangement 18 includes a punching device which, as indicated in FIG. 1 of the drawing, includes two punching blades 100 that are arranged on a vertically displaceable punching beam 98. The driving of the punching device 98, 100 is by means of a transmission chain 102 (see FIGS. 5 and 6) from the main shaft 44, via a non-illustrated cam or crank drive. Such driving occurs synchronously with a pendulum transmission 105 (see FIG. 2) which shifts the card stack 12 transversely with respect to the transportation direction of the main conveyor arrangement 18 into a punching position 104 and which transports the card stack 12 back to the main conveyor arrangement 18 after the completion of the punching operation. The pendulum transmission 105 includes a cam wheel 106 which is mounted on the main shaft 44 and which preferably consists of two cam disks. Respective rollers 108 of a two-armed pendulum lever 112, which carries at its free end a shifting member 110, engage the cam surfaces of the cam wheel 106. The non-illustrated translatory and rotary bearings of the edge punching stations 20 and 22 are constructed as low-friction ball or roller bearings, so that basically only the inertial and weight forces that are to be applied during the displacement of the punching device 98, 100 are to be overcome by the driving mechanism. In view of the desire for minimizing the operating power, it is advantageous so to select the mass of the punching beam 98 that it provides, under the gravitational forces, a substantial contribution to the punching operation. On the other hand, the achievable cycling frequency of the installation is decisively determined by the masses to be moved in the corner punching stations 24. Under these points of view, it has been found to be optimum when the mass of the punching beam 98 is so chosen that its gravitational force corresponds responds to at least 0.5 times, and preferably to 0.6 to 1 times the force which is needed for the punching through of the respective card stack 12, and when the force which is still missing for the accomplishment of the punching-through operation is applied by the driving mechanism. When utilizing a cam drive, it is currently preferred, because of the possible step-down ratio, to utilize the somewhat higher mass forces and correspondingly a smaller motor power, while the lower mass forces are to be utilized at a higher motor power when employing the crank drive.

The card stacks 12 being worked on are transferred at the downstream end 88 of the main conveyor arrangement 18 to the transfer conveyor arrangement 30 the transfer conveyor 30' of which is driven in synchronism with the main conveyor 18', for instance by means of the central shaft 38.

While the present invention has been described and illustrated herein as embodied in a specific construction of a card producing and packaging machine, it is not limited to the details of this particular construction, since various modifications and structural changes are possible and contemplated by the present invention. Thus, the scope of the present invention will be determined exclusively by the appended claims.

What is claimed is:

1. An arrangement for the manufacture and packaging of cards, especially playing cards, comprising a cutting and stacking station operative for cutting out cards from printed sheets and for assembling pluralities of the cards belonging to respective sets into respective card stacks;

two corner punching stations equipped with respective punching blades for the removal of the card corners;

a packaging station for the packaging of the card stacks, means for conveying the card stacks, including an intermittently operated main conveyor, a transfer conveyor connecting said cutting and stacking station with said main conveyor, two supply and return conveyors each of which connects said main conveyor with one of said corner punching stations and is operated during rest times of said main conveyor, and another transfer conveyor which connects said main conveyor with said packaging station; and means for jointly driving all of said stations and conveoors, including a single motor and synchronizing transmissions.

2. The arrangement as defined in claim 1, wherein said main conveyor is oriented horizontally and includes two conveyor chains that are arranged at a transverse distance from one another and are simultaneously driven from an intermittently turning shaft of said driving means, a plurality of entraining members arranged between said conveyor chains one after the other as considered in the longitudinal direction of said main conveyor, two pluralities of insertion shafts arranged on opposite sides of said entraining members and each connecting said entraining members to one of said conveyor chains, said insertion shafts of one of said pluralities being offset by a predetermined distance in said longitudinal direction from said insertion shaft of the other of said pluralities, respective reversing chain sprockets arranged at respective longitudinal ends of said main conveyor and having said conveyor chains trained thereabout, said reversing chain sprockets being mounted for rotation about axes which are offset from one another in said longitudinal direction by said predetermined distance, and a plurality of entraining fingers each upwardly projecting from one of said entraining members.

3. The arrangement as defined in claim 2, and further comprising a multitude of rollers each mounted on one of said entraining shafts, and a rolling track which is contacted by said rollers at least at the region of an upper run of said main conveyor.

4. The arrangement as defined in claim 3, wherein said main conveyor further includes at the region of the upper run thereof and at an upward distance from said running track a transporting trough including a bottom wall having a slot-shaped opening for the passage of said entraining fingers therethrough and two lateral walls, said walls delimiting an upwardly open transportation channel for the card stacks.

5. The arrangement as defined in claim 2, wherein said driving means includes a stepping transmission connected with said motor and operative for intermittently driving said conveyor chains of said main conveyor.

6. The arrangement as defined in claim 5, wherein said stepping transmission includes a driving cam wheel mounted on a continuously rotating shaft and provided with entraining cams, and a driven wheel which is intermittently turnable by said cams of said driving cam wheel and is coupled with a transmission chain for the main conveyor.

7. The arrangement as defined in claim 6, wherein said driven wheel is a toothed wheel.

8. The arrangement as defined in claim 6, wherein said driven wheel is a roller wheel.

9. The arrangement as defined in claim 6, wherein said transfer conveyor which extends from said cutting and stacking station to said main conveyor includes a conveyor chain which is intermittently driven by said driving cam wheel,and another driven wheel, said conveyor chain including additional entraining fingers penetrating into a discharge of said cutting and stacking station, and into the end of which that is remote from said cutting and stacking station there extend said entraining fingers of said main conveyor.

10. The arrangement as defined in claim 1, wherein said transfer conveyor includes a pendulum transmission which is driven by a cam wheel mounted on a main shaft and has a free end, and a shifting element for the card stacks mounted on said free end of said pendulum, movable transversely of said main conveyor, and extending into the path of said main conveyor.

11. The arrangement as defined in claim 1, wherein each of said supply and return conveyors includes a pendulum transmission which is driven by a cam weeel mounted on a main shaft and has a free end, and a shifting element for the card stacks mounted on said free end of said pendulum, movable transversely of said main conveyor into and out of the respective corner punching station, and extending into the path of said main conveyor.

12. The arrangement as defined in claim 1, wherein each of said corner punching stations includes a punching beam and a plurality of punching blades mounted on said punching beam; and wherein said driving means includes a transmission which moves said punching beam perpendicularly to the then stationary respective card stack.

13. The arrangement as defined in claim 12, wherein said transmission is a cam transmission.

14. The arrangement as defined in claim 12, wherein said transmission is a crank transmission.

15. The arrangement as defined in claim 12, wherein said corner punching station has translators and rotary bearings which are constructed as low-friction rolling-type bearings; and wherein a mass force exerted on the respective card stack through said punching blades as a result of the mass of said punching beam and the gravitational forces amounts to at least 0.5 times of the punching force that is needed for punching through the card stack, while the remainder of the needed punching force is supplied by said joint driving means.

16. The arrangement as defined in claim 15, wherein said mass force amounts to between 0.6 and 1 times the needed punching force.

17. The arrangement as defined in claim 1, wherein said additional transfer conveyor which leads to said packaging station includes a conveyor chain which is driven by said motor and includes entraining fingers for the card stacks present at the downstream end of said main conveyor.

18. The arrangement as defined in claim 17, wherein said joint driving means continuously drives said additional transfer conveyor.

19. The arrangement as defined in claim 17, wherein said joint driving means intermittently drives said additional transfer conveyor.

* * * * *